US006140002A

United States Patent [19]

Shimizu et al.

[11] Patent Number: 6,140,002

[45] Date of Patent: Oct. 31, 2000

[54] BINDER RESIN FOR TONERS AND TONERS

[75] Inventors: Koji Shimizu; Motoshi Inagaki; Yoko Harada; Noriyuki Tajiri, all of Toyohashi, Japan

[73] Assignee: Mitsubishi Rayon Co., Ltd., Tokyo, Japan

[21] Appl. No.: 08/973,552

[22] PCT Filed: Jun. 13, 1996

[86] PCT No.: PCT/JP96/01616

§ 371 Date: Dec. 19, 1997

§ 102(e) Date: Dec. 19, 1997

[87] PCT Pub. No.: WO97/00466

PCT Pub. Date: Jan. 3, 1997

[30] Foreign Application Priority Data

| | | | |
|---|---|---|---|
| Jun. 19, 1995 | [JP] | Japan | 7-152050 |
| Jun. 19, 1995 | [JP] | Japan | 7-152051 |
| Dec. 26, 1995 | [JP] | Japan | 7-339422 |

[51] Int. Cl.[7] ..... G03G 9/087

[52] U.S. Cl. ..... 430/109; 526/318.4

[58] Field of Search ..... 430/109; 526/318.4

[56] References Cited

U.S. PATENT DOCUMENTS

| | | | |
|---|---|---|---|
| 4,499,168 | 2/1985 | Mitsuhashi . | |
| 4,626,488 | 12/1986 | Inoue | 430/109 |
| 4,954,411 | 9/1990 | Nishibayashi et al. | 430/109 |
| 5,264,311 | 11/1993 | Nakano et al. | 430/109 |
| 5,338,638 | 8/1994 | Tsuchiya et al. | 430/109 |
| 5,364,721 | 11/1994 | Asada et al. | 430/109 |
| 5,422,218 | 6/1995 | Tong . | |

FOREIGN PATENT DOCUMENTS

| | | |
|---|---|---|
| 0 331 393 | 9/1989 | European Pat. Off. . |
| 0 488 413 | 6/1992 | European Pat. Off. . |
| 0 488 414 | 6/1992 | European Pat. Off. . |
| 0 573 705 | 12/1993 | European Pat. Off. . |
| 0 619 527 | 10/1994 | European Pat. Off. . |
| 0 639 800 | 2/1995 | European Pat. Off. . |
| 35 14 835 | 10/1985 | Germany . |
| 63-32182 | 6/1988 | Japan . |
| 63-32183 | 6/1988 | Japan . |
| 63-32382 | 6/1988 | Japan . |
| 3-48506 | 7/1991 | Japan . |

OTHER PUBLICATIONS

Patent Abstracts of Japan, vol. 11, No. 331 (P–630), Oct. 29, 1987, JP 62–115170, May 26, 1987.

*Primary Examiner*—Christopher D. Rodee
*Attorney, Agent, or Firm*—Oblon, Spivak, McClelland, Maier & Neustadt, P.C.

[57] ABSTRACT

A binder resin for toners which comprises a styrene-acrylic resin comprising a high molecular weight polymer component and a low molecular weight polymer component, wherein, in terms of the molecular weight distribution as measured by gel permeation chromatography, the high molecular weight polymer component has a first peak in the region of molecular weight $5\times10^4$ to $8\times10^5$ and at least 2 peaks and/or shoulders at the high molecular weight side above the molecular weight of the first peak, as well as a toner containing the resin.

8 Claims, No Drawings

BINDER RESIN FOR TONERS AND TONERS

TECHNICAL FIELD

The present invention relates to a binder resin for toners which are used for electrophotography, electrostatic printing, etc. and to a toner which employs the resin. More specifically, the present invention relates to a binder resin for toners which has a wide molecular weight distribution of high molecular polymer components and gives excellent toner fixation and anti-offset property, as well as to a toner which employs the resin.

BACKGROUND ART

Typical image forming processes involving electrophotography and electrostatic printing include a developing step in which a photo conductive insulating layer is uniformly electrified, an electrical latent image is formed by dissipating the charge on the exposed sections once the dielectric layer has been exposed to light and a fine powder toner carrying a charge is adhered to the latent image to render it visible, a transfer step in which the resulting visible image is transferred to a transfer material such as transfer paper, and a fixing step for permanently fixing it by heat or pressure.

The toners and toner binder resins used in electrophotography and electrostatic printing must have a number of different properties for each of these steps. For example, in order to adhere the toner to the electrical latent image in the developing step, the toner and toner binder resin must maintain an amount of charge suitable for copying machines without being affected by the temperature or humidity of the surrounding environment. Also, in the fixation step using a heated roller fixing system, they must have an anti-offset property so as not to stick to heated rollers, while having satisfactory fixability onto the paper. Blocking resistance is also required so that the toner does not undergo blocking during storage in the copying machine.

Styrene-acrylic resins have been widely used as toner resins in the past, and especially linear resins and crosslinked resins. In the case of linear resins, a high molecular weight polymer is blended with a low molecular weight polymer to improve the toner fixing property and anti-offset property. However, with toners which employ such resins, for instance when the fixing property is improved, the melt viscosity of the resin decreases and the anti-offset property of the toner is lowered, and it is therefore difficult to obtain toner with an adequate balance between the two. Attempts have therefore been made to improve the balance between fixing property and anti-offset property by widening the molecular weight distribution of the resin.

For example, in Japanese Examined Patent Publication No. 63-32182, No.63-32183, No.63-32382 and 3-48506 there are proposed methods for improving the balance between fixing property and anti-offset property by widening the molecular weight distribution of the resin, by means of a blend of high molecular weight polymers and low molecular weight polymers with specific molecular weight distributions. However, it has still not been possible to fully satisfy demands for both the fixing property and anti-offset property by simple blending of high molecular weight polymers and low molecular weight polymers.

DISCLOSURE OF THE INVENTION

It is therefore an object of the present invention to provide a binder resin for toners which contains high molecular weight polymer components and low molecular weight polymer components in a wider molecular weight distribution to achieve a satisfactory balance between the toner fixing property and anti-offset property, as well as a toner which employs the resin.

In light of the circumstances described above, the present inventors have carried out diligent research in regard to molecular weight distributions of high molecular weight polymer components of toner binder resins and, as a result, have completed the present invention based upon the finding that toner binder resins which have a satisfactory balance between both toner fixing property and anti-offset property can be provided by using high molecular weight polymer components with specific molecular weight distributions.

In other words, the binder resin for toners according to the invention comprises a styrene-acrylic resin comprising a high molecular weight polymer component and a low molecular weight polymer component, wherein, in terms of the molecular weight distribution as measured by gel permeation chromatography, the high molecular weight polymer component has a first peak in the region of molecular weight $5\times10^4$ to $8\times10^5$ and has at least 2 peaks and/or shoulders at the high molecular weight side above the molecular weight of the first peak. The toner of the invention comprises a styrene-acrylic resin with these characteristics as the binder resin.

The toner binder resin of the invention is a styrene-acrylic resin wherein the high molecular weight polymer component and low molecular weight polymer component are uniformly blended, and wherein both of the polymers are copolymers of a styrene monomer and a copolymerizable vinyl monomer.

BEST MODE FOR CARRYING OUT THE INVENTION

As styrene monomers which may be used for polymerization of the high molecular weight polymer component and low molecular weight polymer component according to the invention there may be mentioned styrene, o-methylstyrene, m-methylstyrene, p-methylstyrene, α-methylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-phenylstyrene, 3,4-dichlorostyrene, etc., among which styrene is preferred. These styrene monomers may be used alone or in combinations of 2 or more.

As copolymerizable vinyl monomers there may be mentioned unsaturated monocarboxylic acid esters such as ethyl acrylate, methyl acrylate, n-butyl acrylate, isobutyl acrylate, propyl acrylate, 2-ethylhexyl acrylate, stearyl acrylate, ethyl methacrylate, methyl methacrylate, n-butyl methacrylate, isobutyl methacrylate, propyl methacrylate, 2-ethylhexyl methacrylate and stearyl methacrylate; and unsaturated dicarboxylic acid diallyl esters such as dimethyl maleate, diethyl maleate, butyl maleate, dimethyl fumarate, diethyl fumarate and dibutyl fumarate.

Also, binder resins with a more excellent balance between toner fixing property and anti-offset property can be obtained by combining carboxylic group-containing vinyl monomers, e.g. unsaturated monocarboxylic acids such as acrylic acid, methacrylic acid and cinnamic acid; unsaturated dicarboxylic acids such as maleic acid, fumaric acid and itaconic acid; and unsaturated dicarboxylic acid monoalkyl esters such as monomethyl maleate, monoethyl maleate, monobutyl maleate, monomethyl fumarate, monoethyl fumarate and monobutyl fumarate.

The copolymerization ratio for these monomers is not critical, but it is preferably selected so that the glass transition temperature of the resulting toner binder resin is in the range of 50–80° C. This is because if the glass transition temperature of the toner binder resin is below 50° C., the blocking temperature of the toner is lowered, which may drastically reduce the storage stability, while if it exceeds 80° C. the softening temperature is increased, resulting in a reduced toner fixing property; the temperature range is preferably 55–70° C.

The toner binder resin comprising the styrene-acrylic resin according to the invention has peaks for each of the low molecular weight polymer component and high molecular weight polymer component, of which preferably the peak for the low molecular weight polymer component is in the region of molecular weight $1\times10^3$ to $3\times10^4$ and the peak for the high molecular weight polymer component is in the region of molecular weight $5\times10^4$ to $8\times10^5$, and more preferably the peak for the low molecular weight polymer component is in the region of molecular weight $2\times10^3$ to $2\times10^4$ and the peak for the high molecular weight polymer component is in the region of molecular weight $1\times10^5$ to $6\times10^5$, all according to a chromatogram produced by gel permeation chromatography. This is because when the peak for the low molecular weight polymer component is in the region of molecular weight below $1\times10^3$, the mechanical strength of the resin is lowered and the toner becomes excessively ground during electrostatic charging, tending to result in fogging of images, whereas when it is in the region exceeding $3\times10^4$ there is a tendency for the toner to have a reduced fixing property. Also, when the peak for the high molecular weight polymer component is in the region of molecular weight below $5\times10^4$ there is a tendency for the toner to have a reduced anti-offset property whereas, when it exceeds the region of $8\times10^5$, there is a tendency for the toner to have a reduced fixing property.

It is important for the toner binder resin according to the invention to have at least 2 peaks and/or shoulders at the high molecular weight side above the molecular weight of the peak (first peak) for the high molecular weight polymer component, in terms of the molecular weight distribution of the high molecular weight polymer component according to a chromatogram measured by gel permeation chromatography. This is because by having at least 2 peaks and/or shoulders at the high molecular weight side above the molecular weight of the first peak for the high molecular weight polymer component it is possible to widen the molecular weight distribution of the high molecular weight polymer component, and thus vastly improve the balance between the toner fixing property and anti-offset property. According to the invention, from the viewpoint of improving the balance between toner fixing property and anti-offset property it is preferred that among the 2 or more peaks and/or shoulders at the high molecular weight side above the molecular weight of the first peak for the high molecular weight polymer component, at least one should be a peak. It is particularly preferred for the peak to be at the high molecular weight side.

The peaks and/or shoulders in addition to the first peak for the high molecular weight polymer component are preferably in the region of molecular weight $1\times10^5$ to $3\times10^6$, and more preferably that of $1.5\times10^5$ to $2\times10^6$. This is because when the peaks and/or shoulders in addition to the first peak for the high molecular weight polymer component are in the region of molecular weight below $1\times10^5$ there is a tendency for the toner anti-offset property to be reduced, whereas when it is in the region of molecular weight exceeding $3\times10^6$ there is a tendency toward lower dispersability of coloring agents, charge controlling agents and the like which are added to prepare the toner. Also, according to the invention, one or more peaks and/or shoulders in addition to the first peak for the high molecular weight polymer component are in the region of molecular weight $1\times10^5$ to $1\times10^6$ and in the region of molecular weight $1\times10^6$ to $3\times10^6$, more preferably one or more peaks are in the region of molecular weight $1.5\times10^5$ to $6\times10^5$ and in the region of molecular weight $1\times10^6$ to $2\times10^6$, and even more preferably one or more peaks are in the region of molecular weight $3\times10^5$ to $6\times10^5$ and in the region of molecular weight $1\times10^6$ to $1.8\times10^6$.

The toner binder resin of the present invention is composed of a high molecular weight polymer component and a low molecular weight polymer component, with the content of the high molecular weight polymer component preferably being in the range of 20–70 wt %. This is because when the high molecular weight polymer component is present at less than 20 wt % there is a tendency for the toner to have an inferior anti-offset property, whereas if it is present at greater than 70 wt % there is a tendency for the toner to have an inferior fixing property; the range is more preferably 20–60 wt %.

According to the invention, the molecular weight and molecular weight distribution of the high molecular weight polymer component in the toner binder resin are controlled to provide a toner with a satisfactory balance between fixing property and anti-offset property, and preferably the weight average molecular weight (Mw) of the high molecular weight polymer component is in the range of $2\times10^5$ to $7\times10^5$ and the ratio of the weight average molecular weight (Mw) to the number average molecular weight (Mn) is in the range of 1.8 to 4.0. This is because if the weight average molecular weight is less than $2\times10^5$ there is a tendency for the toner to have a reduced anti-offset property, whereas if it exceeds $7\times10^5$ there is a tendency for the toner to have a reduced fixing property; the range is more preferably $3\times10^5$ to $6\times10^5$. Also, if Mw/Mn for the high molecular weight polymer component is less than 1.8 there is a tendency for the toner to have a reduced anti-offset property, whereas if it is greater than 4.0 there is a tendency for a slower heat response and a reduced fixing property of the toner at low temperatures; the range is more preferably 2.0 to 3.8.

The low molecular weight polymer component in the toner binder resin of the invention preferably have a weight average molecular weight in the range of $5\times10^3$ to $3\times10^4$. This is because if the weight average molecular weight of the low molecular weight polymer component is less than $5\times10^3$, the mechanical strength of the resin is lowered and the toner becomes excessively ground during electrostatic charging, tending to result in fogging of images. Conversely, if the weight average molecular weight exceeds $3\times10^4$ there is a tendency for the toner to have a reduced fixing property. More preferably, the weight average molecular weight of the low molecular weight polymer component is in the range of $7\times10^3$ to $2\times10^4$.

According to the invention there is also provided a toner with an further improved balance between fixing property and anti-offset property, by controlling the melt property in addition to the molecular weight of the high molecular weight polymer component in the styrene-acrylic copolymer. That is, it becomes possible to provide a binder resin with an excellent balance between toner fixing property and anti-offset property, by adjusting the elution start time (Ts), the top elution time (Tt) and the elution end time (Te) in gel permeation chromatography of the high molecular weight polymer component so as to satisfy the relationship of expression (1) below. If the melt property of the high molecular weight polymer component fails to satisfy expression (1), the heat response of the styrene-acrylic copolymer as the toner binder resin will be delayed, resulting in a reduced fixing property of the toner.

$$Ts-Tt \leqq Tt-Te \quad (1)$$

According to the invention, the elution start time (Ts), the top elution time (Tt) and the elution end time (Te) mentioned above in the measurement by gel permeation chromatography of the styrene-acrylic copolymer are given in terms of time (minutes) required from the start of measurement, with the elution start time (Ts) representing the time (minutes) until start of elution of the high molecular weight polymer components, the top elution time (Tt) representing the time (minutes) until elution of the peak having the maximum height in the molecular weight distribution by gel permeation chromatography of the high molecular weight polymer component, and the elution end time (Te) representing the time (minutes) until completion of elution of the high molecular weight polymer component.

According to the invention it is further preferred for the elution start time (Ts), the top elution time (Tt) and the elution end time (Te) to satisfy the relationship of expression (2) below, from the standpoint of balance between the toner fixing property and anti-offset property. It is more preferred that they satisfy the relationship of expression (3), and even more preferred that they satisfy the relationship of expression (4).

$$(Ts-Tt)/(Tt-Te) \geqq 1.5 \quad (2)$$

$$5 \geqq (Ts-Tt)/(Tt-Te) \geqq 1.5 \quad (3)$$

$$3 \geqq (Ts-Tt)/(Tt-Te) \geqq 1.6 \quad (4)$$

The styrene-acrylic copolymer which is the toner binder resin according to the invention may be produced by polymerizing the aforementioned styrene monomer(s) and the other copolymerizable vinyl monomer(s) by a known polymerization method such as suspension polymerization, solution polymerization, emulsion polymerization or bulk polymerization. Suspension polymerization is particularly preferred among these because it uses no solvent and thus involves no problem of odor due to residual solvent, it allows easier control of heat release, uses low amounts of polymerization dispersants, and does not impair moisture resistance.

Polymerization by suspension polymerization is preferably carried out by loading the aforementioned monomers and a polymerization initiator into a sealed vessel to perform suspension polymerization of the high molecular weight polymer component under conditions with a temperature of at least 95° C., and subsequently performing suspension polymerization of the low molecular weight polymer component at 95° C. or higher in the presence of suspended particles of the high molecular weight polymer component.

The polymerization initiator to be used for suspension polymerization of the high molecular weight polymer component may be a compound with at least 3 t-butylperoxide groups per molecule or a radical polymerization initiator with a 10-hour half-life temperature of 90–140° C. and one functional group per molecule. An example of a compound with at least 3 t-butylperoxide groups per molecule is 2,2-bis(4,4-di-t-butylperoxycyclohexyl) propane. As radical polymerization initiators with a 10-hour half-life temperature of 90–140° C. and one functional group per molecule there may be mentioned organic peroxides and azo compounds such as t-butyl peroxylaurate, t-butyl peroxy-3,5,5-trimethylhexanoate, cyclohexanone peroxide, t-butyl peroxyisopropylcarbonate, t-butyl peroxyacetate, t-butyl peroxybenzoate, dicumyl peroxide, t-butylcumyl peroxide, diisopropylbenzene hydroperoxide, di-t-butyl peroxide, p-methane hydroperoxide, 2-(carbamoylazo) isobutyronitrile, 2,2-azobis(2,4,4-trimethylpentane) and 2-phenylazo-2,4-dimethyl-4-methoxy valeronitrile. These polymerization initiators may be used alone or in combinations of 2 or more. The amount of polymerization initiator to be used can be exceedingly small compared to the amount of polymerization initiator used for conventional suspension polymerization, and is preferably in the range of 0.001–0.5 part by weight, and more preferably 0.002–0.05 part by weight, per 100 parts by weight of the total monomer portion. This is because if the polymerization initiator is used at less than 0.001 part by weight a longer time will tend to be required to reach the desired polymerization reaction rate, and if it is used at greater than 0.5 part by weight the molecular weight of the high molecular weight polymer component will tend to be insufficiently high.

According to the invention, a multifunctional vinyl monomer is also used as a crosslinking agent in a range of no greater than 0.05 part by weight per 100 parts by weight of the total monomer portion, and this range is preferred to be from 0.002 to 0.02 part by weight. This is because if the multifunctional vinyl monomer is used at greater than 0.05 part by weight the low molecular weight polymer component and high molecular weight polymer component will tend to not mix uniformly. As multifunctional vinyl monomers to be used there may be mentioned aromatic divinyl compounds such as divinylbenzene and divinylnaphthalene; as well as ethyleneglycol di(meth)acrylate, triethyleneglycol di(meth)acrylate, tetraethyleneglycol di(meth)acrylate, polyethyleneglycol di(meth)acrylate, dipropyleneglycol di(meth)acrylate, 1,3-butyleneglycol di(meth)acrylate and bisphenol A derivative-based di(meth)acrylates, which may be used either alone or in combinations of 2 or more. Among these there are particularly preferred divinylbenzene and 1,3-butyleneglycol di(meth)acrylate.

According to the invention, suspension polymerization of the high molecular weight polymer components may be carried out at a high temperature of at least 95° C., and preferably at least 100° C., while using one of the aforementioned polymerization initiators or crosslinking agents, for efficient consumption of the polymerization initiator, to provide a high molecular weight polymer component with a high weight average molecular weight of $3\times10^5$ or greater and a specific molecular weight distribution within a short time of about 1 to 3 hours. If the polymerization temperature is below 95° C. a longer time will usually be required to reach the desire polymerization reaction rate.

The suspension polymerization of the low molecular weight polymer component is not critical, and for example, it is preferred for the polymerization to be initiated by dissolving a polymerization initiator for a low molecular weight polymer in water or in the monomer mix for the low molecular weight polymer and adding this solution at the point at which the polymerization reaction rate of the high molecular weight polymer component is about 10–90%. If the monomer mix for the low molecular weight polymer is added, it is preferably added in an amount such that the content of the low molecular weight polymer component in the resulting resin is in the range of 50–90 wt %.

The polymerization initiator used for suspension polymerization of the low molecular weight polymer component is not critical and may be any commonly employed peroxide or azo compound with a radical polymerizability, examples of which include di-t-butyl peroxide, t-butylcumyl peroxide, dicumyl peroxide, acetyl peroxide, isobutyryl peroxide, octanonyl peroxide, decanonyl peroxide, lauroyl peroxide, 3,5,5-trimethylhexanoyl peroxide, benzoyl peroxide, m-toluoyl peroxide, t-butyl peroxyacetate, t-butyl peroxyisobutylate, t-butyl peroxypiperate, t-butyl peroxyneodecanoate, cumyl peroxyneodecanoate, t-butyl peroxy-2-ethylhexanoate, t-butyl peroxy-3,5,5-trimethylhexanoate, t-butyl peroxylilate, t-butyl peroxybenzoate, t-butyl peroxyisopropylcarbonate, azobisisobutylnitrile and 2,2-azobis-(2,4-dimethylvaleronitrile); among these there are preferred octanonyl peroxide, decanonyl peroxide, lauroyl peroxide, benzoyl peroxide and m-toluoyl peroxide from the standpoint of long-lasting polymerization activity for the monomers and relatively rapid completion of polymerization. These polymerization initiators may be used either alone or in combinations of 2 or more, and are preferably used in a range of 0.1–10 parts by weight, and more preferably in a range of 0.5–10 parts by weight, to 100 parts by weight of the monomer portion.

According to the invention, the suspension polymerization may be carried out by adding a dispersing agent, polymerization initiator and if necessary a dispersing aid or chain transfer agent, etc. with water in an amount of 1 to 10 times and preferably about 2 to 4 times the amount of the monomers, raising the temperature to the desired polymerization temperature, and continuing heating until the desired rate of polymerization is achieved.

The dispersion stabilizer used for the suspension polymerization may be polyvinyl alcohol, an alkali metal salt of a simple polymer or copolymer of (meth)acrylic acid, carboxymethyl cellulose, gelatin, starch, barium sulfate, calcium sulfate, calcium carbonate, magnesium carbonate or calcium phosphate, among which polyvinyl alcohol is preferred, and particularly preferred is partial saponified polyvinyl alcohol with acetic groups or hydroxyl groups in block form. These dispersants are preferably used in a range of 0.01 to 5 parts by weight to 100 parts by weight of the water. This is because if the dispersant is used at less than 0.01 part by weight there is a tendency for the polymer to solidify by aggregation of the product particles due to lower stability during the suspension polymerization, while at greater than 5 parts by weight there is a tendency toward greater environmental dependency of the toner, and particularly lower moisture resistance; a more preferred range is 0.05 to 2 parts by weight. If necessary, a dispersing aid such as sodium chloride, potassium chloride, sodium sulfate or potassium sulfate may be used in combination with the dispersants. Also, if necessary for adjustment of the molecular weight there may also be used a chain transfer agent such as n-octylmercaptan, n-dodecylmercaptan, t-dodecylmercaptan, 2-ethylhexyl thioglycolate or α-methylstyrene dimer.

The toner binder resin of the invention obtained by the production method described above preferably has a softening temperature in the range of 110–160° C. This is because when the softening temperature is lower than 110° C. there is a tendency for the toner to have an inferior anti-offset property, and when it is higher than 160° C. there is a tendency for the toner to have a reduced fixing property; a more preferred range is 120–140° C. Also, the resin preferably contains substantially no THF (tetrahydrofuran)-insoluble portion, or specifically speaking, the THF-insoluble portion is preferably no greater than 0.5 wt %, more preferably no greater than 0.1 wt % and even more preferably no greater than 0.05 wt %. This is because if the THF-insoluble portion is greater than 0.5 wt % there is a tendency for poorer dispersability of pigments and the like, and cleavage of the crosslinked structure by the high shear force produced by dispersion, resulting in a reduced anti-offset property.

The toner of the invention contains the aforementioned styrene-acrylic copolymer as the binder resin, and here the styrene-acrylic copolymer may be used alone as the binder resin or alternatively the styrene-acrylic copolymer may be used as simply the major component of the binder resin, in combination with another resin such as another styrene/acrylic resin or a styrene/butadiene resin or polyester resin. Also, the toner of the invention may be prepared by including at least 60 wt % of the aforementioned binder resin, further mixing therewith a coloring agent, for example an inorganic pigment such as carbon black or iron black, a chromatic colored dye or an organic pigment, a wax such as polyolefin wax, or a negative or positive charge controlling agent, and then crushing and sorting the resulting mixture after melt kneading to achieve the desired average particle size.

The present invention will now be explained in more detail by way of examples.

In the examples, the glass transition temperatures were determined by raising the temperature of each sample to 100° C. for melt quenching, followed by DSC (differential scanning calorimetry) (temperature-elevating rate of 10° C./min). The softening temperature was indicated by the temperature at which ½ of the sample volume ran off using a flow tester with a 1 mmϕ×10 mm nozzle (CFT-500, product of Shimazu Laboratories) under conditions of a 30 Kgf load and a temperature-elevating rate of 3° C./min. The weight average molecular weight (Mw), number average molecular weight (Mn):molecular weight distribution, elution start time (Ts), top elution time (Tt) and elution end time (Te) were the values measured by gel permeation chromatography. The measurement by gel permeation chromatography was carried out by placing 0.04 g of sample and 9.96 g of tetrahydrofuran in a sample bottle, inserting the stopper, holding the solution overnight, and then shaking the sample bottle and filtering the tetrahydrofuran solution of the sample with a 0.5 μm filter to prepare the sample for gel permeation chromatography with an HCL-8020 manufactured by Toso Co. (column: Toso TSKgel $GMH_{XL}$/3, column temperature: 38° C., detector: RI, pour volume: 100 μl), while a calibration curve was prepared using standard polystyrene F2000/F700/F288/F128/F80/F40/F20/F2/A1000 by Toso Co. and styrene monomer, with the value obtained by polystyrene conversion.

The weight average molecular weight (Mw) was determined by subjecting a 0.5 wt % resin solution in tetrahydrofuran as the solvent to centrifugation at 12000 rpm for 30 minutes and measuring the resulting supernatant solution with an HCL-8020 manufactured by Toso Co., with the value obtained by polystyrene conversion.

The fixation property was determined using a fixation tester with a fully adjustable fixation temperature, at a fixation rate of 130 mm/sec and a pressure of 40 kg, applying cellophane tape to the fixed toner image, with visual examination of the change in the image density before and after peeling off the cellophane tape, and was evaluated based on the following criteria.

○: small change in image density x: considerable change in image density.

The anti-offset property was determined using a fixation tester with a fully adjustable fixation temperature, at a fixation rate of 130 mm/sec and a pressure of 40 kg, with visual examination of the degree of residual toner on the fixing roller, and was evaluated based the following criteria.

◎: virtually no residue

○: small residue x: considerable residue.

The storage stability was determined by placing the toner in a hot air drier kept at about 50° C., with visual examination of the blocking condition before and after standing for 50 hours, and was evaluated based on the following criteria.

◎: no blocking

○: slight blocking x: considerable blocking.

The moisture resistance was determined by measuring the charge after standing for about 20 hours in an environment of 30° C. and 85% humidity and the charge after standing for about 20 hours in an environment of 10° C. and 15% humidity, and evaluating the environmental dependence based on the following criteria.

○: virtually no environmental dependence x: considerable environmental dependence.

EXAMPLE 1

After dissolving 0.02 part by weight of 2,2-bis(4,4-di-t-butylperoxycyclohexyl)propane ("Percadox 12", product of Kayaku Akuzo Co.) as a polymerization initiator in a monomer mixture comprising 41.5 parts by weight of styrene and 8.5 parts by weight of n-butyl acrylate, the solution was added to, and stirred with, a mixture of 200 parts by weight of deionized water and 0.2 part by weight of partially saponified polyvinyl alcohol ("Gosenol GH-23", product of Nihon Synthetic Chemical Industries). The temperature was then raised to 130° C. for one hour to accomplish suspension polymerization of the high molecular weight polymer. The polymerization reaction rate during this time was about 60%. To the high molecular weight polymer dispersion which had been cooled to 40° C. there were added 41.5 parts by weight of styrene, 8.5 parts by weight of n-butyl acrylate, 6 parts by weight of benzoyl peroxide and 1 part by weight of t-butyl peroxybenzoate ("Perbutyl Z", product of Nihon Yushi Co.), and the temperature was raised to 130° C. for 1.5 hours to accomplish suspension polymerization of the low molecular weight polymer. The polymerization reaction rate during this time was about 99%. This was followed by cooling to room temperature, adequate washing with water and dehydrating to dryness to obtain a styrene-acrylic toner binder resin as a uniform mixture of the high molecular weight polymer component and low molecular weight polymer component. The softening temperature and glass transition temperature of the resulting toner binder resin and the weight average molecular weights, contents, molecular weight distributions and melt properties of the high molecular weight polymer component and low molecular weight polymer component are listed in Table 1.

After kneading 93 parts by weight of the toner binder resin obtained above, 5 parts by weight of carbon black (#40 by Mitsubishi Chemical Co.), 1 part by weight of a charge controlling agent ("Bontron S-34" manufactured by Orient Chemical Industries) and 1 part by weight of polypropylene wax ("660P" manufactured by Sanyo Chemical Co.) with a twin-screw extruder at 150° C. for about 5 minutes, the mixture was pulverized using a jet mill pulverizer and sorted to obtain a toner with a particle size of 5–15 μm. The results of evaluating the fixing property, anti-offset property, storage stability and moisture resistance of the resulting toner are given in Table 2.

EXAMPLE 2

After dissolving 0.02 part by weight of 2,2-bis(4,4-di-t-butylperoxycyclohexyl)propane ("Percadox 12", product of Kayaku Akuzo Co.) as a polymerization initiator and 0.01 part by weight of divinylbenzene as a crosslinking agent in a monomer mixture comprising 41.5 parts by weight of styrene and 8.5 parts by weight of n-butyl acrylate, the solution was added to and stirred with a mixture of 200 parts by weight of deionized water and 0.2 part by weight of partially saponified polyvinyl alcohol ("Gosenol GH-23", product of Nihon Synthetic Chemical Industries). The temperature was then raised to 130° C. for one hour to accomplish suspension polymerization of the high molecular weight polymer. The polymerization reaction rate during this time was about 60%. To the high molecular weight polymer dispersion which had been cooled to 40° C. there were added 41.5 parts by weight of styrene, 8.5 parts by weight of n-butyl acrylate, 6 parts by weight of benzoyl peroxide and 1 part by weight of t-butyl peroxybenzoate ("Perbutyl Z", product of Nihon Yushi Co.), and the temperature was raised to 130° C. for 1.5 hours to accomplish suspension polymerization of the low molecular weight polymer. The polymerization reaction rate during this time was about 100%. This was followed by cooling to room temperature, adequate washing with water and dehydrating to dryness to obtain a styrene-acrylic toner binder resin as a uniform mixture of the high molecular weight polymer component and low molecular weight polymer component. The softening temperature and glass transition temperature of the resulting toner binder resin and the weight average molecular weights, contents, molecular weight distributions and melt properties of the high molecular weight polymer component and low molecular weight polymer component are listed in Table 1.

After kneading 93 parts by weight of the toner binder resin obtained above, 5 parts by weight of carbon black (#40 by Mitsubishi Chemical Co.), 1 part by weight of a charge controlling agent ("Bontron S-34" manufactured by Orient Chemical Industries) and 1 part by weight of polypropylene wax ("660P" manufactured by Sanyo Chemical Co.) with a twin-screw extruder at 150° C. for about 5 minutes, the mixture was pulverized using a jet mill pulverizer and sorted to obtain a toner with a particle size of 5–15 μm. The results of evaluating the fixing property, anti-offset property, storage stability and moisture resistance of the resulting toner are given in Table 2.

EXAMPLE 3

After dissolving 0.02 part by weight of 2,2-bis(4,4-di-t-butylperoxycyclohexyl)propane ("Percadox 12", product of Kayaku Akuzo Co.) as a polymerization initiator and 0.025 part by weight of divinylbenzene as a crosslinking agent in a monomer mixture comprising 41.5 parts by weight of styrene and 8.5 parts by weight of n-butyl acrylate, the solution was added to and stirred with a mixture of 200 parts by weight of deionized water and 0.2 part by weight of partially saponified polyvinyl alcohol ("Gosenol GH-23", product of Nihon Synthetic Chemical Industries). The temperature was then raised to 130° C. for one hour to accomplish suspension polymerization of the high molecular weight polymer. The polymerization reaction rate during this time was about 50%. To the high molecular weight polymer dispersion which had been cooled to 40° C. there were added 41.5 parts by weight of styrene, 8.5 parts by weight of n-butyl acrylate, 6 parts by weight of benzoyl peroxide and 1 part by weight of t-butyl peroxybenzoate ("Perbutyl Z", product of Nihon Yushi Co.), and the temperature was raised to 130° C. for 1.5 hours to accomplish suspension polymerization of the low molecular weight polymer. The polymerization reaction rate during this time was about 100%. This was followed by cooling to room temperature, adequate washing with water and dehydrating to dryness to obtain a styrene-acrylic toner binder resin as a uniform mixture of the high molecular weight polymer component and low molecular weight polymer component. The softening temperature and glass transition temperature of the resulting toner binder resin and the weight average molecular weights, contents, molecular weight distributions and melt properties of the high molecular weight polymer component and low molecular weight polymer component are listed in Table 1.

After kneading 93 parts by weight of the toner binder resin obtained above, 5 parts by weight of carbon black (#40 by Mitsubishi Chemical Co.), 1 part by weight of a charge controlling agent ("Bontron S-34" manufactured by Orient Chemical Industries) and 1 part by weight of polypropylene wax ("660P" manufactured by Sanyo Chemical Co.) with a twin-screw extruder at 150° C. for about 5 minutes, the mixture was pulverized using a jet mill pulverizer and sorted to obtain a toner with a particle size of 5–15 μm. The results of evaluating the fixing property, anti-offset property, storage stability and moisture resistance of the resulting toner are given in Table 2.

EXAMPLE 4

After dissolving 0.03 part by weight of t-butyl peroxybenzoate ("Perbutyl Z", product of Nihon Yushi Co.) as a polymerization initiator and 0.01 part by weight of divinylbenzene as a crosslinking agent in a monomer mixture comprising 41.5 parts by weight of styrene and 8.5 parts by weight of n-butyl acrylate, the solution was added to and stirred with a mixture of 200 parts by weight of deionized water and 0.2 part by weight of partially saponified polyvinyl alcohol ("Gosenol GH-23", product of Nihon Synthetic Chemical Industries). The temperature was then raised to 130° C. for 2 hours to accomplish suspension polymerization of the high molecular weight polymer. The polymerization reaction rate during this time was about 66%. To the high molecular weight polymer dispersion which had been cooled to 40° C. there were added 41.5 parts by weight of styrene, 8.5 parts by weight of n-butyl acrylate, 6 parts by weight of benzoyl peroxide and 1 part by weight of t-butyl peroxybenzoate ("Perbutyl Z", product of Nihon Yushi Co.), and the temperature was raised to 130° C. for 1.5 hours to accomplish suspension polymerization of the low molecular weight polymer. The polymerization reaction rate during this time was about 99%. This was followed by cooling to room temperature, adequate washing with water and dehydrating to dryness to obtain a styrene-acrylic toner binder resin as a uniform mixture of the high molecular weight polymer component and low molecular weight polymer component. The softening temperature and glass transition temperature of the resulting toner binder resin and the weight average molecular weights, contents, molecular weight distributions and melt properties of the high molecular weight polymer component and low molecular weight polymer component are listed in Table 1.

After kneading 93 parts by weight of the toner binder resin obtained above, 5 parts by weight of carbon black (#40 by Mitsubishi Chemical Co.), 1 part by weight of a charge controlling agent ("Bontron S-34" manufactured by Orient Chemical Industries) and 1 part by weight of polypropylene wax ("660P" manufactured by Sanyo Chemical Co.) with a twin-screw extruder at 150° C. for about 5 minutes, the mixture was pulverized using a jet mill pulverizer and sorted to obtain a toner with a particle size of 5–15 μm. The results of evaluating the fixing property, anti-offset property, storage stability and moisture resistance of the resulting toner are given in Table 2.

EXAMPLE 5

After dissolving 0.03 part by weight of t-butyl peroxybenzoate ("Perbutyl Z", product of Nihon Yushi Co.) as a polymerization initiator and 0.025 part by weight of divinylbenzene as a crosslinking agent in a monomer mixture comprising 41.5 parts by weight of styrene and 8.5 parts by weight of n-butyl acrylate, the solution was added to and stirred with a mixture of 200 parts by weight of deionized water and 0.2 part by weight of partially saponified polyvinyl alcohol ("Gosenol GH-23", product of Nihon Synthetic Chemical Industries). The temperature was then raised to 130° C. for 2 hours to accomplish suspension polymerization of the high molecular weight polymer. The polymerization reaction rate during this time was about 70%. To the high molecular weight polymer dispersion which had been cooled to 40° C. there were added 41.5 parts by weight of styrene, 8.5 parts by weight of n-butyl acrylate, 6 parts by weight of benzoyl peroxide and 1 part by weight of t-butyl peroxybenzoate ("Perbutyl Z", product of Nihon Yushi Co.), and the temperature was raised to 130° C. for 1.5 hours to accomplish suspension polymerization of the low molecular weight polymer. The polymerization reaction rate during this time was about 100%. This was followed by cooling to room temperature, adequate washing with water and dehydrating to dryness to obtain a styrene-acrylic toner binder resin as a uniform mixture of the high molecular weight polymer component and low molecular weight polymer component. The softening temperature and glass transition temperature of the resulting toner binder resin and the weight average molecular weights, contents, molecular weight distributions and melt properties of the high molecular weight polymer component and low molecular weight polymer component are listed in Table 1.

After kneading 93 parts by weight of the toner binder resin obtained above, 5 parts by weight of carbon black (#40 by Mitsubishi Chemical Co.), 1 part by weight of a charge controlling agent ("Bontron S-34" manufactured by Orient Chemical Industries) and 1 part by weight of polypropylene wax ("660P" manufactured by Sanyo Chemical Co.) with a twin-screw extruder at 150° C. for about 5 minutes, the mixture was pulverized using a jet mill pulverizer and sorted to obtain a toner with a particle size of 5–15 μm. The results of evaluating the fixing property, anti-offset property, storage stability and moisture resistance of the resulting toner are given in Table 2.

EXAMPLE 6

After dissolving 0.03 part by weight of 2,2-bis(4,4-di-t-butylperoxycyclohexyl)propane ("Percadox 12", product of Kayaku Akuzo Co.) as a polymerization initiator in a monomer mixture comprising 41.75 parts by weight of styrene, 7.5 parts by weight of n-butyl acrylate and 0.75 part by weight of methacrylic acid, the solution was added to and stirred with a mixture of 200 parts by weight of deionized water and 0.2 part by weight of partially saponified polyvinyl alcohol ("Gosenol GH-23", product of Nihon Synthetic Chemical Industries). The temperature was then raised to 130° C. for 2 hours to accomplish suspension polymerization of the high molecular weight polymer. The polymerization reaction rate during this time was about 70%. To the high molecular weight polymer dispersion which had been cooled to 40° C. there were added 44.25 parts by weight of styrene, 5 parts by weight of n-butyl acrylate, 0.75 part by weight of methacrylic acid, 5 parts by weight of benzoyl peroxide and 1 part by weight of t-butyl peroxybenzoate ("Perbutyl Z", product of Nihon Yushi Co.), and the temperature was raised to 130° C. for 1.5 hours to accomplish suspension polymerization of the low molecular weight polymer. The polymerization reaction rate during this time was about 100%. This was followed by cooling to room temperature, adequate washing with water and dehydrating to dryness to obtain a styrene-acrylic toner binder resin as a uniform mixture of the high molecular weight polymer component and low molecular weight polymer component. The softening temperature and glass transition temperature of the resulting toner binder resin and the weight average molecular weights, contents, molecular weight distributions and melt properties of the high molecular weight polymer component and low molecular weight polymer component are listed in Table 1.

After kneading 93 parts by weight of the toner binder resin obtained above, 5 parts by weight of carbon black (#40 by Mitsubishi Chemical Co.), 1 part by weight of a charge controlling agent ("Bontron S-34" manufactured by Orient Chemical Industries) and 1 part by weight of polypropylene wax ("660P" manufactured by Sanyo Chemical Co.) with a twin-screw extruder at 150° C. for about 5 minutes, the mixture was pulverized using a jet mill pulverizer and sorted to obtain a toner with a particle size of 5–15 μm. The results of evaluating the fixing property, anti-offset property, storage stability and moisture resistance of the resulting toner are given in Table 2.

COMPARATIVE EXAMPLE 1

After dissolving 0.02 part by weight of t-butyl peroxybenzoate ("Perbutyl Z", product of Nihon Yushi Co.) as a polymerization initiator in a monomer mixture comprising 41.5 parts by weight of styrene and 8.5 parts by weight of n-butyl acrylate, the solution was added to and stirred with a mixture of 200 parts by weight of deionized water and 0.2 part by weight of partially saponified polyvinyl alcohol ("Gosenol GH-23", product of Nihon Synthetic Chemical Industries). The temperature was then raised to 130° C. for 2 hours to accomplish suspension polymerization of the high molecular weight polymer. The polymerization reaction rate during this time was about 70%. To the high molecular weight polymer dispersion which had been cooled to 40° C. there were added 41.5 parts by weight of styrene, 8.5 parts by weight of n-butyl acrylate, 6 parts by weight of benzoyl peroxide and 1 part by weight of t-butyl peroxybenzoate ("Perbutyl Z", product of Nihon Yushi Co.), and the temperature was raised to 130° C. for 1.5 hours to accomplish suspension polymerization of the low molecular weight polymer. The polymerization reaction rate during this time was about 100%. This was followed by cooling to room temperature, adequate washing with water and dehydrating to dryness to obtain a styrene-acrylic toner binder resin as a uniform mixture of the high molecular weight polymer component and low molecular weight polymer component. The softening temperature and glass transition temperature of the resulting toner binder resin and the weight average molecular weights, contents, molecular weight distributions and melt properties of the high molecular weight polymer component and low molecular weight polymer component are listed in Table 1.

After kneading 93 parts by weight of the toner binder resin obtained above, 5 parts by weight of carbon black (#40 by Mitsubishi Chemical Co.), 1 part by weight of a charge controlling agent ("Bontron S-34" manufactured by Orient Chemical Industries) and 1 part by weight of polypropylene wax ("660P" manufactured by Sanyo Chemical Co.) with a twin-screw extruder at 150° C. for about 5 minutes, the mixture was pulverized using a jet mill pulverizer and sorted to obtain a toner with a particle size of 5–15 μm. The results of evaluating the fixing property, anti-offset property, storage stability and moisture resistance of the resulting toner are given in Table 2.

COMPARATIVE EXAMPLE 2

A 0.2 part by weight portion of potassium peroxodisulfate was dissolved as a polymerization initiator in a monomer mixture comprising 20 parts by weight of styrene and 5 parts by weight of n-butyl acrylate. This was then added dropwise to an aqueous solution of 0.5 part by weight of sodium dodecylbenzenesulfonate in 150 parts by weight of deionized water, and the mixture was stirred. After subsequent substitution with nitrogen at 40° C. for 30 minutes, the temperature was raised to 70° C. for emulsion polymerization of the high molecular weight polymer for 4.5 hours. The polymerization reaction rate during this time was about 70%. To the high molecular weight polymer dispersion which had been cooled to 40° C. there were added 50 parts by weight of deionized water and 0.2 part by weight of partially saponified polyvinyl alcohol ("Gosenol GH-23", product of Nihon Synthetic Chemical Industries). After further adding 60 parts by weight of styrene, 15 parts by weight of n-butyl acrylate, 5 parts by weight of benzoyl peroxide and 1 part by weight of t-butyl peroxybenzoate ("Perbutyl Z", product of Nihon Yushi Co.), the temperature was raised to 130° C. for 2 hours to accomplish suspension polymerization of the low molecular weight polymer. The polymerization reaction rate during this time was about 100%. This was followed by cooling to room temperature, adequate washing with water and dehydrating to dryness to obtain a styrene-acrylic toner binder resin as a uniform mixture of the high molecular weight polymer component and low molecular weight polymer component. The softening temperature and glass transition temperature of the resulting toner binder resin and the weight average molecular weights, contents, molecular weight distributions and melt properties of the high molecular weight polymer component and low molecular weight polymer component are listed in Table 1.

After kneading 93 parts by weight of the toner binder resin obtained above, 5 parts by weight of carbon black (#40 by Mitsubishi Chemical Co.), 1 part by weight of a charge controlling agent ("Bontron S-34" manufactured by Orient Chemical Industries) and 1 part by weight of polypropylene wax ("660P" manufactured by Sanyo Chemical Co.) with a twin-screw extruder at 150° C. for about 5 minutes, the mixture was pulverized using a jet mill pulverizer and sorted to obtain a toner with a particle size of 5–15 μm. The results of evaluating the fixing property, anti-offset property, storage stability and moisture resistance of the resulting toner are given in Table 2.

TABLE 1

| | Resin Properties | | | | | | |
|---|---|---|---|---|---|---|---|
| | | Glass | High molecular weight polymer component | | | Low molecular weight polymer component | |
| | Softening temp. (° C.) | transition temp. (° C.) | Wt. average molecular weight | Mw/Mn | Content (%) | Wt. average molecular weight | Content (%) |
| Example 1 | 120 | 53 | $3.57 \times 10^5$ | 2.1 | 30 | $1.0 \times 10^4$ | 70 |
| Example 2 | 121 | 53 | $5.42 \times 10^5$ | 2.6 | 29 | $1.05 \times 10^4$ | 71 |
| Example 3 | 124 | 53 | $4.77 \times 10^5$ | 2.6 | 24 | $1.11 \times 10^4$ | 76 |
| Example 4 | 128 | 54 | $4.26 \times 10^5$ | 2.3 | 33 | $9.43 \times 10^3$ | 67 |
| Example 5 | 130 | 54 | $5.28 \times 10^5$ | 2.7 | 36 | $1.05 \times 10^4$ | 64 |
| Example 6 | 138 | 65 | $4.23 \times 10^5$ | 2.1 | 36 | $1.11 \times 10^4$ | 64 |
| Comp. Example 1 | 120 | 52 | $2.70 \times 10^5$ | 1.7 | 33 | $9.8 \times 10^3$ | 67 |
| Comp. Example 2 | 132 | 60 | $9.77 \times 10^5$ | 1.9 | 25 | $1.15 \times 10^4$ | 75 |

| | Resin properties | | | | | | |
|---|---|---|---|---|---|---|---|
| | Molecular weight distribution by GPC | | | | Melt properties | | |
| | Molecular weight at peak top for low molecular weight polymer component | Molecular weights at peaks/shoulder for high molecular weight polymer component | | | Elution start time (Ts) | Top elution time (Tt) | Elution end time (Te) |
| | | First peak | Peak | Shoulder | | | |
| Example 1 | $7.8 \times 10^3$ | $2.33 \times 10^5$ | $1.46 \times 10^6$ | $5.64 \times 10^5$ | 18.13 | 22.82 | 25.29 |
| Example 2 | $6.5 \times 10^3$ | $1.86 \times 10^5$ | $1.52 \times 10^6$ | $4.26 \times 10^5$ | 18.00 | 23.24 | 25.04 |
| Example 3 | $5.5 \times 10^3$ | $1.54 \times 10^5$ | $1.48 \times 10^6$ | $4.63 \times 10^5$ | 18.20 | 23.59 | 25.12 |
| Example 4 | $5.1 \times 10^3$ | $1.93 \times 10^5$ | $1.25 \times 10^6$ | $3.82 \times 10^5$ | 18.18 | 23.17 | 25.52 |
| Example 5 | $4.1 \times 10^3$ | $1.46 \times 10^5$ | $1.37 \times 10^6$ | $4.23 \times 10^5$ | 18.22 | 23.68 | 25.65 |
| Example 6 | $6.8 \times 10^3$ | $1.73 \times 10^5$ | $1.41 \times 10^6$ | $3.89 \times 10^5$ | 18.11 | 23.31 | 25.47 |
| Comp. Example 1 | $7.0 \times 10^3$ | $1.96 \times 10^5$ | — | — | 20.99 | 23.16 | 25.35 |
| Comp. Example 2 | $7.2 \times 10^3$ | $7.93 \times 10^5$ | $1.21 \times 10^6$ | — | 17.45 | 20.27 | 23.47 |

TABLE 2

| | Toner properties | | | |
|---|---|---|---|---|
| | Fixing property | Anti-offset property | Storage stability | Moisture resistance |
| Example 1 | ○ | ○ | ○ | ○ |
| Example 2 | ○ | ○ | ○ | ○ |
| Example 3 | ○ | ○ | ○ | ○ |
| Example 4 | ○ | ◎ | ○ | ○ |
| Example 5 | ○ | ◎ | ○ | ○ |
| Example 6 | ○ | ◎ | ◎ | ○ |
| Comp. Example 1 | ○ | X | ○ | ○ |
| Comp. Example 2 | ○ | X | X | X |

EXAMPLE 7

After dissolving 0.015 part by weight of 2,2-bis(4,4-di-t-butylperoxycyclohexyl)propane ("Percadox 12", product of Kayaku Akuzo Co.) as a polymerization initiator in a monomer mixture comprising 25.5 parts by weight of styrene and 4.5 parts by weight of n-butyl acrylate, the solution was added to and stirred with a mixture of 200 parts by weight of deionized water and 0.2 part by weight of partially saponified polyvinyl alcohol ("Gosenol GH-23", product of Nihon Synthetic Chemical Industries). The temperature was then raised to 130° C. for 2 hours to accomplish suspension polymerization of the high molecular weight polymer. The polymerization reaction rate during this time was about 67%. To the high molecular weight polymer dispersion which had been cooled to 40° C. there were added 63 parts by weight of styrene, 7 parts by weight of n-butyl acrylate, 5 parts by weight of benzoyl peroxide and 1 part by weight of t-butyl peroxybenzoate ("Perbutyl Z", product of Nihon Yushi Co.), and the temperature was raised to 130° C. for 1.5 hours to accomplish suspension polymerization of the low molecular weight polymer. The polymerization reaction rate during this time was about 99%. This was followed by cooling to room temperature, adequate washing with water and dehydrating to dryness to obtain a styrene-acrylic toner binder resin as a uniform mixture of the high molecular weight polymer component and low molecular weight polymer component.

After combining 93 parts by weight of the styrene-acrylic copolymer obtained above, 4 parts by weight of carbon black (#40 by Mitsubishi Chemical Co.), 1 part by weight of a negative charge controlling agent ("Bontron S-34" manufactured by Orient Chemical Industries) and 2 parts by weight of polypropylene wax ("660P" manufactured by Sanyo Chemical Co.), the mixture was subjected to melt kneading at 145° C. It was then pulverized using a jet mill pulverizer and sorted to obtain a toner with an average particle size of 13 $\mu$m.

The resulting toner had a glass transition temperature of 64.5° C. and a softening temperature of 130° C. Also, the binder resin in the toner had a weight average molecular weight of 370,000, while the elution start time (Ts) was 18.62 minutes, the top elution time (Tt) was 22.72 minutes and the elution end time (Te) was 24.77 minutes as measured by gel permeation chromatography, and the high molecular weight polymer component content was 20.1 wt %. The weight average molecular weight of the low molecular weight polymer component was 14,000.

The fixing temperature range for the resulting toner was at a practical level of 140–200° C., and no image fogging was found.

EXAMPLE 8

After dissolving 0.042 part by weight of 2,2-bis(4,4-di-t-butylperoxycyclohexyl)propane ("Percadox 12", product of Kayaku Akuzo Co.) as a polymerization initiator in a monomer mixture comprising 59.5 parts by weight of styrene and 10.5 parts by weight of n-butyl acrylate, the solution was added to and stirred with a mixture of 200 parts by weight of deionized water and 0.2 part by weight of partially saponified polyvinyl alcohol ("Gosenol GH-23", product of Nihon Synthetic Chemical Industries). The temperature was then raised to 130° C. for 2 hours to accomplish suspension polymerization of the high molecular weight polymer. The polymerization reaction rate during this time was about 70%. To the high molecular weight polymer dispersion which had been cooled to 40° C. there were added 27 parts by weight of styrene, 3 parts by weight of n-butyl acrylate, 5 parts by weight of benzoyl peroxide and 1 part by weight of t-butyl peroxybenzoate ("Perbutyl Z", product of Nihon Yushi Co.), and the temperature was raised to 130° C. for 1.5 hours to accomplish suspension polymerization of the low molecular weight polymer. The polymerization reaction rate during this time was about 99%. This was followed by cooling to room temperature, adequate washing with water and dehydrating to dryness to obtain a styrene-acrylic toner binder resin as a uniform mixture of the high molecular weight polymer component and low molecular weight polymer component.

After combining 93 parts by weight of the styrene-acrylic copolymer obtained above, 4 parts by weight of carbon black (#40 by Mitsubishi Chemical Co.), 1 part by weight of a negative charge controlling agent ("Bontron S-34" manufactured by Orient Chemical Industries) and 2 parts by weight of polypropylene wax ("660P" manufactured by Sanyo Chemical Co.), the mixture was subjected to melt kneading at 145° C. It was then pulverized using a jet mill pulverizer and sorted to obtain a toner with an average particle size of 13 $\mu$m.

The resulting toner had a glass transition temperature of 60.0° C. and a softening temperature of 130° C. Also, the binder resin in the toner had a weight average molecular weight of 380,000, while the elution start time (Ts) was 18.36 minutes, the top elution time (Tt) was 23.14 minutes and the elution end time (Te) was 25.97 minutes as measured by gel permeation chromatography, and the high molecular weight polymer component content was 48.8 wt %. The weight average molecular weight of the low molecular weight polymer component was 9,000.

The fixing temperature range for the resulting toner was at a practical level of 130–220° C., and no image fogging was found.

EXAMPLE 9

After dissolving 0.042 part by weight of 2,2-bis(4,4-di-t-butylperoxycyclohexyl)propane ("Percadox 12", product of Kayaku Akuzo Co.) as a polymerization initiator in a monomer mixture comprising 55 parts by weight of styrene and 20 parts by weight of n-butyl acrylate, the solution was added to and stirred with a mixture of 200 parts by weight of deionized water and 0.2 part by weight of partially saponified polyvinyl alcohol ("Gosenol GH-23", product of Nihon Synthetic Chemical Industries). The temperature was then raised to 130° C. for 2 hours to accomplish suspension polymerization of the high molecular weight polymer. The polymerization reaction rate during this time was about 71%. To the high molecular weight polymer dispersion which had been cooled to 40° C. there were added 25 parts by weight of styrene, 4 parts by weight of benzoyl peroxide and 1 part by weight of t-butyl peroxybenzoate ("Perbutyl Z", product of Nihon Yushi Co.), and the temperature was raised to 130° C. for 1.5 hours to accomplish suspension polymerization of the low molecular weight polymer. The polymerization reaction rate during this time was about 99%. This was followed by cooling to room temperature, adequate washing with water and dehydrating to dryness to obtain a styrene-acrylic toner binder resin as a uniform mixture of the high molecular weight polymer component and low molecular weight polymer component.

After combining 93 parts by weight of the styrene-acrylic copolymer obtained above, 4 parts by weight of carbon black (#40 by Mitsubishi Chemical Co.), 1 part by weight of a negative charge controlling agent ("Bontron S-34" manufactured by Orient Chemical Industries) and 2 parts by weight of polypropylene wax ("660P" manufactured by Sanyo Chemical Co.), the mixture was subjected to melt kneading at 145° C. It was then pulverized using a jet mill pulverizer and sorted to obtain a toner with an average particle size of 13 $\mu$m.

The resulting toner had a glass transition temperature of 57.0° C. and a softening temperature of 130° C. Also, the binder resin in the toner had a weight average molecular weight of 520,000, while the elution start time (Ts) was 17.79 minutes, the top elution time (Tt) was 22.82 minutes and the elution end time (Te) was 25.36 minutes as measured by gel permeation chromatography, and the high molecular weight polymer component content was 53.1 wt %. The weight average molecular weight of the low molecular weight polymer component was 9,000.

The fixing temperature range for the resulting toner was at a practical level of 120–210° C., and no image fogging was found.

COMPARATIVE EXAMPLE 3

A monomer mixture comprising 28 parts by weight of styrene and 12 parts by weight of n-butyl acrylate was loaded into an autoclave, and after nitrogen substitution the temperature was raised to 120° C. for bulk polymerization for 16 hours. After adding 50 parts by weight of xylene and continuously pouring the mixture over a period of 8 hours into an autoclave holding 0.04 part by weight of dibutyl peroxide dissolved in 50 parts by weight of ethylbenzene at 130° C., polymerization was conducted for 2 hours. The temperature was then raised to 200° C., and a solution of di-t-butyl peroxide at an amount of 0.5 mole to 100 moles of styrene in a mixed solution comprising 60 parts by weight of styrene and 30 parts by weight of a xylene/ethylbenzene mixed solvent was continuously poured over a period of 3 hours into an autoclave kept at 200° C., and polymerization was continued for one hour until completion of the reaction. The resulting polymer solution was heated to 200° C. and flushed into a 10 mmHg vacuum system to remove the solvent and obtain a styrene-acrylic copolymer.

After combining 93 parts by weight of the styrene-acrylic copolymer obtained above, 4 parts by weight of carbon black (#40 by Mitsubishi Chemical Co.), 1 part by weight of a negative charge controlling agent ("Bontron S-34" manufactured by Orient Chemical Industries) and 2 parts by weight of polypropylene wax ("660P" manufactured by Sanyo Chemical Co.), the mixture was subjected to melt kneading at 145° C. It was then pulverized using a jet mill pulverizer and sorted to obtain a toner with an average particle size of 13 μm.

The resulting toner had a glass transition temperature of 57.0° C. and a softening temperature of 132° C. Also, the binder resin in the toner had a weight average molecular weight of 450,000, while the elution start time (Ts) was 18.04 minutes, the top elution time (Tt) was 21.83 minutes and the elution end time (Te) was 26.67 minutes as measured by gel permeation chromatography, and the high molecular weight polymer component content was 33.9 wt %. The weight average molecular weight of the low molecular weight polymer component was 5,000.

The fixing temperature range for the resulting toner was 160–210° C., which was not at a practical level, and image fogging was also found.

COMPARATIVE EXAMPLE 4

A monomer mixture comprising 37 parts by weight of styrene and 13 parts by weight of n-butyl acrylate was loaded into an autoclave, and after nitrogen substitution the temperature was raised to 120° C. for bulk polymerization for 10 hours. After adding 50 parts by weight of xylene and continuously pouring the mixture over a period of 8 hours into an autoclave holding 0.04 part by weight of dibutyl peroxide dissolved in 50 parts by weight of ethylbenzene at 130° C., polymerization was conducted for 2 hours. The temperature was then raised to 200° C., and a solution of di-t-butyl peroxide at an amount of 0.3 mole to 100 moles of styrene in a mixed solution comprising 50 parts by weight of styrene and 30 parts by weight of a xylene/ethylbenzene mixed solvent was continuously poured over a period of 3 hours into an autoclave kept at 200° C., and polymerization was continued for one hour until completion of the reaction. The resulting polymer solution was heated to 200° C. and flushed into a 10 mmHg vacuum system to remove the solvent and obtain a styrene-acrylic copolymer.

After combining 93 parts by weight of the styrene-acrylic copolymer obtained above, 4 parts by weight of carbon black (#40 by Mitsubishi Chemical Co.), 1 part by weight of a negative charge controlling agent ("Bontron S-34" manufactured by Orient Chemical Industries) and 2 parts by weight of polypropylene wax ("660P" manufactured by Sanyo Chemical Co.), the mixture was subjected to melt kneading at 145° C. It was then pulverized using a jet mill pulverizer and sorted to obtain a toner with an average particle size of 13 μm.

The resulting toner had a glass transition temperature of 58.0° C. and a softening temperature of 130° C. Also, the binder resin in the toner had a weight average molecular weight of 340,000, while the elution start time (Ts) was 18.43 minutes, the top elution time (Tt) was 22.22 minutes and the elution end time (Te) was 26.13 minutes as measured by gel permeation chromatography, and the high molecular weight polymer component content was 41.7 wt %. The weight average molecular weight of the low molecular weight polymer component was 7,000.

The fixing temperature range for the resulting toner was 160–210° C., which was not at a practical level, and image fogging was also found.

INDUSTRIAL APPLICABILITY

According to the present invention, there are provided binder resins for toners, and toners employing the resins, which have a wider molecular weight distribution of a high molecular weight polymer component and give an excellent fixing property and anti-offset property for toners, by including therein a high molecular weight polymer component having a specific molecular weight distribution in gel permeation chromatography.

We claim:

1. A binder resin for toners, which comprises:

a styrene-acrylic resin comprising a high molecular weight polymer component which is present in an amount of 20–70 wt. % of the binder resin and which has a weight average molecular weight of $2\times10^5$ to $7\times10^5$ with a ratio of weight average molecular weight to number average molecular weight of 1.8 to 4 and a low molecular weight polymer component having a weight average molecular weight of $5\times10^3$ to $3\times10^4$, wherein, in terms of the molecular weight distribution as measured by gel permeation chromatography, the main peak of the low molecular weight polymer component ranges in molecular weight from $1\times10^3$ to $3\times10^4$ and the high molecular weight polymer component has a first peak in the molecular weight region ranging from $5\times10^4$ to $8\times10^5$ and has two or more peaks, two or more shoulders or one or more peaks and one or more shoulders at the high molecular weight side above the molecular weight of the first peak.

2. A binder resin for toners according to claim 1, which has at least one peak at the high molecular weight end above the molecular weight of the said first peak of the high molecular weight polymer component.

3. A binder resin for toners according to claim 1, wherein the peaks and/or shoulders at the high molecular weight side above the molecular weight of said first peak of the high molecular weight polymer component are in the region of molecular weight $1\times10^5$ to $3\times10^6$.

4. A binder resin for toners according to claim 3, wherein at least one of the peaks and/or shoulders at the high molecular weight side above the molecular weight of said first peak of the high molecular weight polymer component is in the molecular weight region of $1\times10^5$ to $1\times10^6$ or in the molecular weight region of $1\times10^6$ to $3\times10^6$.

5. A binder resin for toners according to claim 4, which has at least one peak in the region of molecular weight $1\times10^6$ to $3\times10^6$.

6. A binder resin for toners according to claim 5, wherein the styrene-acrylic resin has a glass transition temperature of 50–80° C. and a softening temperature of 110–160° C.

7. A binder resin for toners according to claim 1, which comprises 20–70 wt % of a high molecular weight polymer component with a weight average molecular weight of $2\times10^5$ to $7\times10^5$ and a low molecular weight polymer component with a weight average molecular weight of $5\times10^3$ to $3\times10^4$, wherein the elution start time (Ts), the top elution time (Tt) and the elution end time (Te) in gel permeation chromatography of said high molecular weight polymer component satisfy the relationship of expression (1) below.

$$Ts-Tt \leqq Tt-Te \quad (1)$$

8. A toner comprising a styrene-acrylic resin according to any one of claim 2, 3, 4, 5, 6, 7, or 1 as a binder resin.

* * * * *